US007429850B1

(12) United States Patent
Wochele

(10) Patent No.: US 7,429,850 B1
(45) Date of Patent: Sep. 30, 2008

(54) BIAS VOLTAGE CONVERTER

(75) Inventor: Fritz Wochele, Aidlingen (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/060,163

(22) Filed: Mar. 31, 2008

(51) Int. Cl.
*G05F 1/613* (2006.01)

(52) U.S. Cl. ..... 323/222; 323/282; 323/351

(58) Field of Classification Search ..... 323/222, 323/265, 282, 351
See application file for complete search history.

(56) References Cited

U.S. PATENT DOCUMENTS

| | | | | |
|---|---|---|---|---|
| 3,987,989 | A | 10/1976 | Geiger | |
| 4,439,692 | A | 3/1984 | Beekmans et al. | |
| 4,553,047 | A | 11/1985 | Dillinger | |
| 4,843,339 | A | 6/1989 | Burt et al. | |
| 6,515,880 | B1 * | 2/2003 | Evans et al. | 363/49 |
| 7,126,314 | B2 * | 10/2006 | McGinty et al. | 323/222 |
| 7,199,560 | B2 * | 4/2007 | Cheung et al. | 323/222 |
| 2001/0001230 | A1 | 5/2001 | Proebsting | |

FOREIGN PATENT DOCUMENTS

| | | |
|---|---|---|
| EP | 0 522 879 | 1/1993 |

* cited by examiner

*Primary Examiner*—Adolf Berhane
(74) *Attorney, Agent, or Firm*—McGinn IP Law Group, PLLC

(57) ABSTRACT

A circuit to generate a bias voltage, the circuit including an inductor, a first capacitor associated with the second inductor node, a diode, and a second capacitor being associated with ground, the second capacitor including a second capacitor node, a switch configured to connect the inductor current to ground when closed. The first capacitor and the second capacitor become charged via the trigger resistor by the inductor current until the trigger node reaches the trigger threshold and the trigger closes the switch when the trigger threshold is reached. The inductor is drained when the switch is opened and, when the inductor current reaches zero, an inductor voltage provides a negative voltage step at the trigger node via the first capacitor and when the negative voltage step is provided to the trigger node, the trigger directs the switch to close.

1 Claim, 6 Drawing Sheets

Relevant Art

Relevant Art

Relevant Art

510

BIAS VOLTAGE CONVERTER

BACKGROUND OF THE INVENTION

1. Field of the Invention

The present invention generally relates to a method and apparatus to generate a bias voltage and more particularly to a method and apparatus to generate a bias voltage between 3.3V and 12V from a small input voltage of about 1V.

2. Description of the Related Art

With the increasing popularity of integrated circuits that need a bias voltage, there is a demand for the generation of a bias voltage between 3.3V and 12V from a small input Voltage of around 1V which is the operation voltage or core voltage for the core voltage of modern computer processors.

FIG. 1 exemplarily illustrates boost circuit 100 and FIGS. 2 and 3 exemplarily illustrate boost circuit 100 in continuous conduction mode 200 and discontinuous conduction mode 300, respectively. Boost circuit 100 is configured to provide an output voltage Vout that is a bias voltage of about 3.3V to 12V. Boost circuit 100 includes oscillator 110, control 120, and switch 130.

In an on-state, the switch 130 is closed, resulting in an increase in an inductor current I ind through the inductor L. In an off-state, the switch 130 is open and the only path offered to the inductor current I ind is through the diode D. The controller 120 receives feedback from the output of the diode D18 and can control the gate 130 accordingly.

FIG. 2 illustrates a continuous mode 200. When boost circuit 100 operates in the continuous mode 200, the inductor current I ind never falls to zero. Referring to FIG. 3, a problem arises in that, under low load conditions a ringing occurs at the inductor, when the circuit operates in a discontinuous conduction mode 300. As the load current gets smaller, the control circuit 120 lowers the duty cycle and the boost circuit 100 transits into the discontinuous conduction mode 300. Then, current through the inductor I ind reaches zero and at this condition large high frequency oscillations occur. These oscillations can disturb other circuits and also unnecessarily consume energy. But because this circuit is used for low current bias voltages, it will always work with low load currents and is always in the DCCM.

Some integrated circuits meet some of these requirements, but are not ideal. These integrated circuits have the following problems. These integrated circuits have a high cost. In some cases, the costs of these integrated circuits are between three to four dollars. In addition, these integrated circuits are relatively too large, since these independent circuits are designed for load currents >300 mA.

Thus, a major drawback for these integrated circuits is the generation of high frequency oscillations when going into a discontinuous conduction mode.

SUMMARY OF THE INVENTION

In view of the foregoing, and other, exemplary problems, drawbacks, and disadvantages of the conventional systems, it is an exemplary feature of the present invention to provide a circuit that is very simple, low cost and meets easily all the requirements without generating high frequency (HF) distortions for the generation of a bias voltage between 3.3V and 12V from a small input Voltage of around 1V.

It is, therefore, an exemplary feature of the present invention to provide a circuit to provide a bias voltage, the circuit including an inductor element including a first inductor node and a second inductor node, the inductor element configured to receive an input voltage at the first inductor node and to output an inductor current, a first capacitor associated with the second inductor node, a diode provided between the first capacitor and the first inductor node, the diode being configured to direct current towards the inductor, a free running oscillator, the free running oscillator having a trigger configured to react with different threshold levels depending on whether a trigger threshold voltage is on a positive transition or on a negative transition upon reaching a trigger threshold, a resistor—capacitor network associated with the trigger, a second capacitor being associated with ground, the second capacitor including a second capacitor node, a trigger resistor, the trigger resistor including a first trigger node associated with the resistor—capacitor network and a second trigger node associated with the second capacitor node, a trigger node configured between the first capacitor and the second capacitor node, and a switch associated with the resistor—capacitor network and the second inductor node, the switch configured to connect the inductor current to ground when closed. The first capacitor and the second capacitor become charged via the trigger resistor by the inductor current until the trigger node reaches the trigger threshold and the trigger closes the switch when the trigger threshold is reached. The inductor is drained when the switch is opened and, when the inductor current reaches zero, an inductor voltage provides a negative voltage step at the trigger node via the first capacitor and when the negative voltage step is provided to the trigger node, the trigger directs the switch to close.

Thus, exemplary embodiments of the present invention can prevent the ringing generated by conventional converter circuits in a low load mode because the next load cycle (ton) of the inductor is initiated by the negative going slope of the inductor voltage. This keeps HF distortions at a minimum. In addition, exemplary embodiments of the present invention will always operate exactly in the transition between the continuous conduction mode) and the discontinuous conduction mode. Furthermore, the oscillator gets synchronized by the falling slope of the inductor when all the energy is transferred and the energy transferred to the output will not exceed a pre adjusted value (depending on Ton) and therefore measures for limitations are not necessary.

BRIEF DESCRIPTION OF THE DRAWINGS

The foregoing and other purposes, aspects and advantages will be better understood from the following detailed description of an exemplary embodiment of the invention with reference to the drawings, in which.

DETAILED DESCRIPTION OF (AN) EXEMPLARY EMBODIMENT(S) OF THE INVENTION

Figure 1:
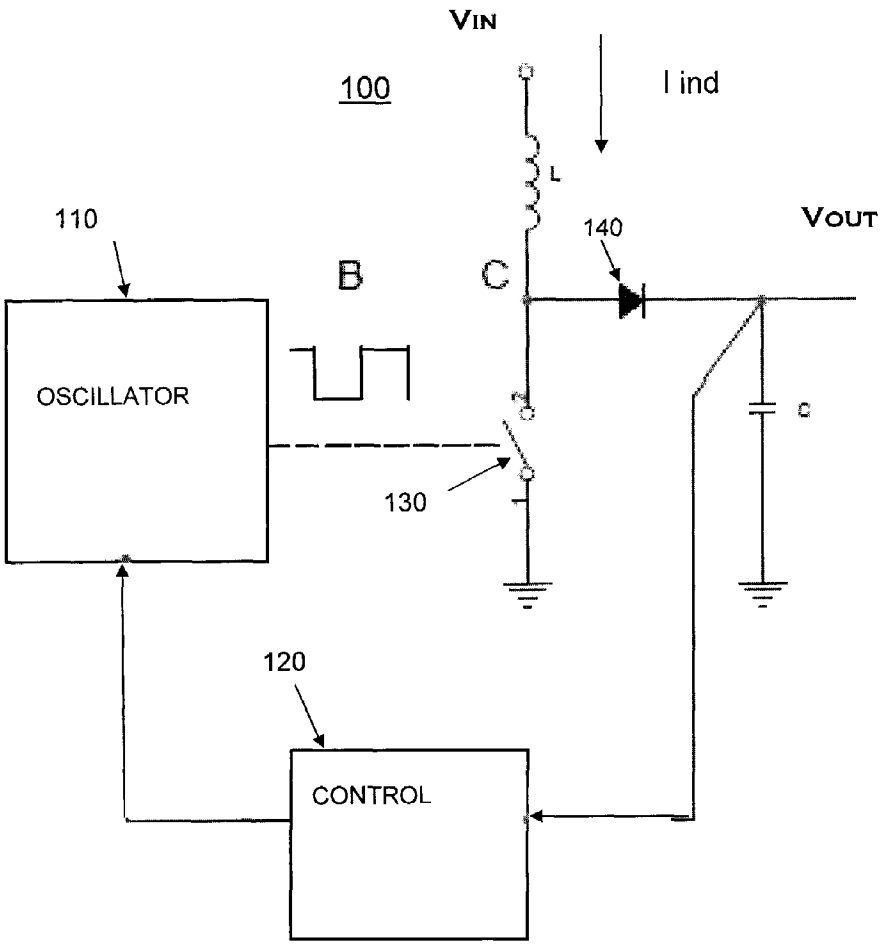
FIG. 1 exemplarily illustrates boost circuit 100.
Figure 3:
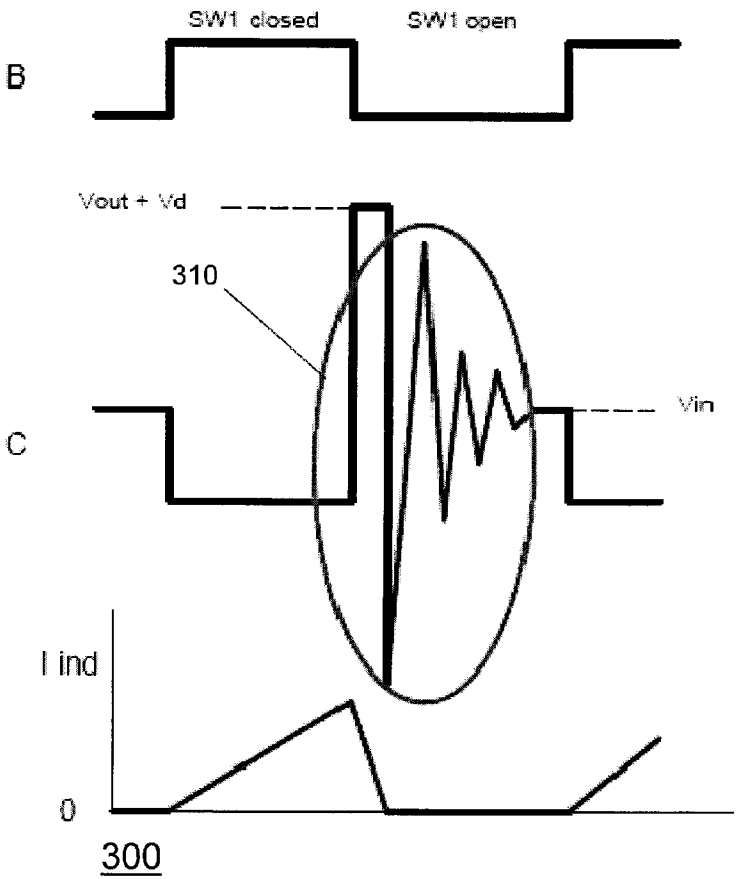
FIG. 3 exemplarily illustrates a timing diagram of boost circuit 100 in a discontinuous conduction mode 300.
Figure 2:
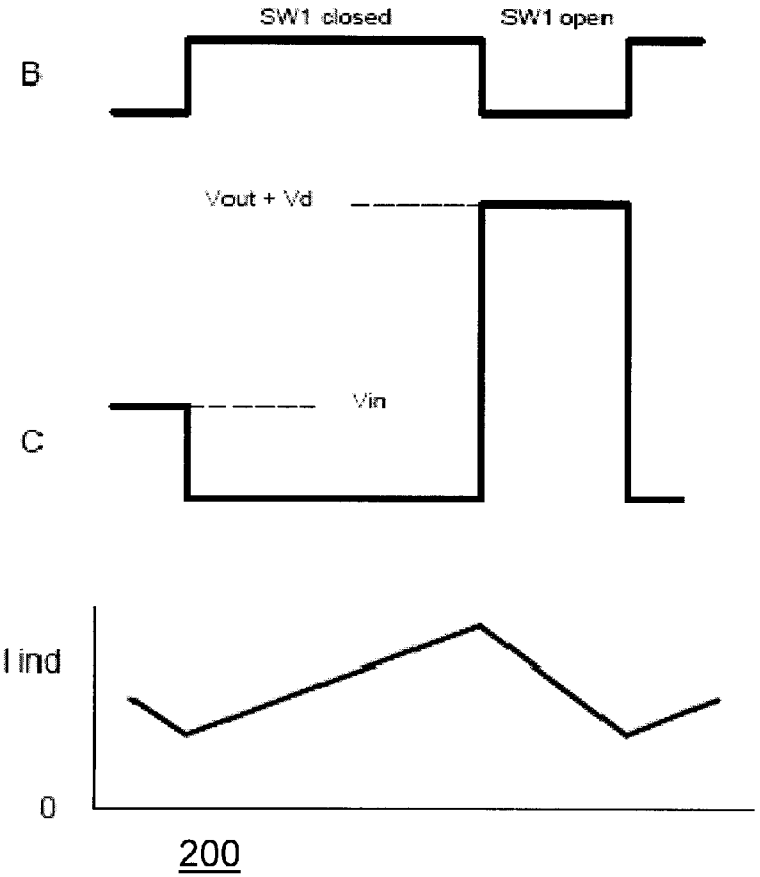
FIG. 2 exemplarily illustrates a timing diagram of boost circuit 100 in continuous conduction mode 200.
Figure 4:
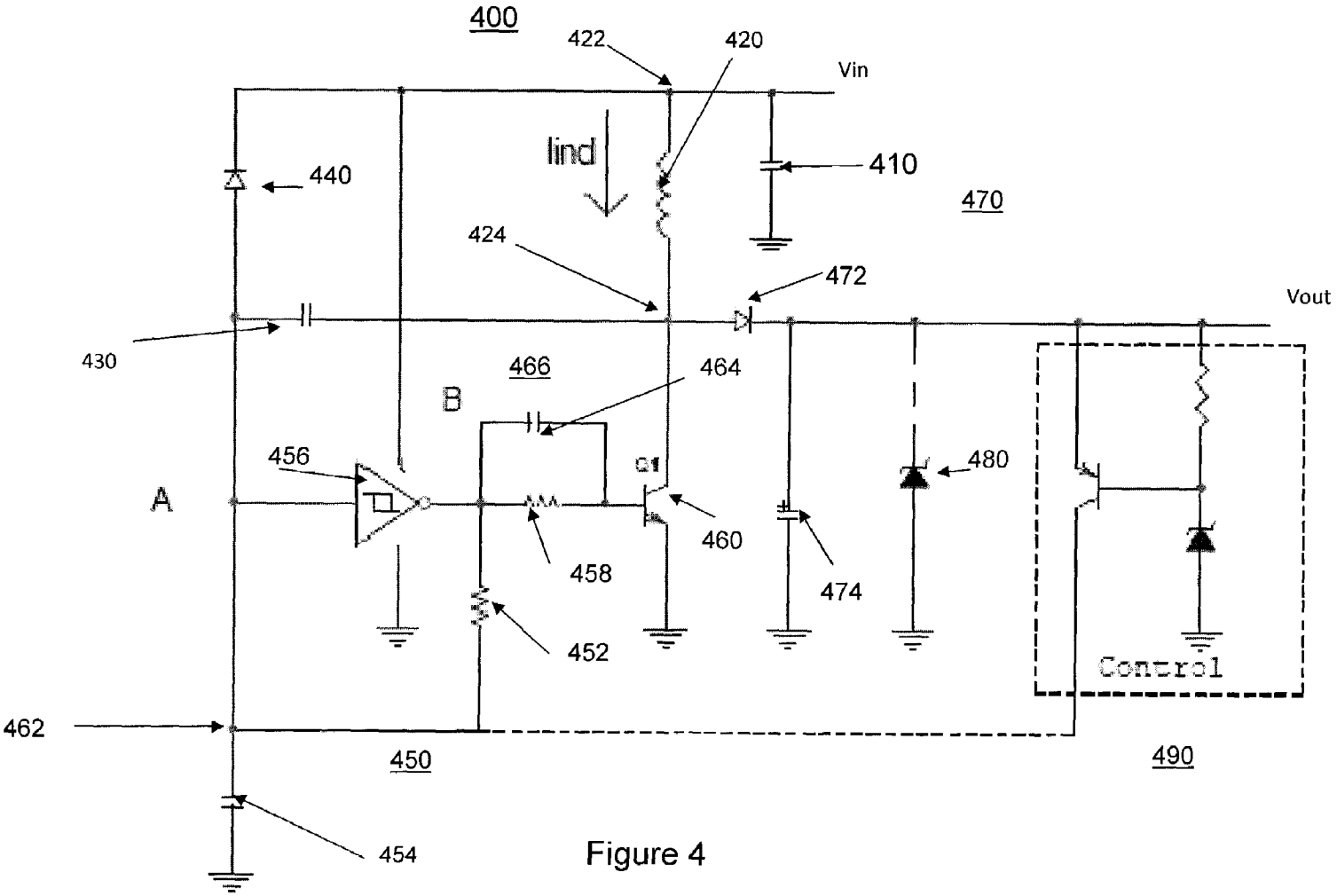
FIG. 4 exemplarily illustrates bias voltage converter 400.

Referring now to the drawings, and more particularly to FIG. 4, there is shown an exemplary embodiment of the method and structures according to the present invention. It is proposed to connect a feedback (inverter) which makes sure that the voltage from time to time be negative. Thus, resulting in a circuit that is very simple, low cost and meets easily all the requirements without generating HF distortions.

FIG. 4 exemplarily illustrates bias voltage converter 400. Referring to FIG. 4, bias voltage converter 400, can provide a bias voltage at low cost and without generating high frequency distortions. In an exemplary embodiment, converter 400 can generate a bias voltage between 3.3V and 12V from a small input voltage of about 1V.

Referring to FIG. 4, converter 400 includes inductor element 420 including a first inductor node 422 and a second inductor node 424. Inductor element 420 is configured to receive input voltage Vin at the first inductor node 422 and to output an inductor current I ind.

Converter 400 also includes input capacitor 410. A first node of input capacitor 410 is provided between the second node 424 of inductor element 420 and input voltage Vin. Input capacitor 410 exemplarily has a capacitance value of 0.1 μF. In addition, input capacitor is exemplarily associated with ground.

Converter 400 also includes first capacitor 430 associated with the second inductor node 424 of inductor element 420. In addition, first diode 440 is provided between first capacitor 430 and the first node 422 of inductor element 420. First diode 440 is configured to direct current towards the first node 422 of inductor element 420 to protect Schmitt trigger 456 from high positive voltages. First capacitor 430 exemplarily has a capacitance value of 100 pf.

First capacitor 430 and diode 440 perform as an inverter. As will be described later, the first capacitor 430 exemplarily allows the present invention to limit Toff, as soon as all the energy in the inductor 420 is released and transferred to a rectifier capacitor 474. When inductor current I ind reaches zero, the voltage at the second inductor node 424 abruptly goes low and causes a negative voltage step via the first capacitor 430. Node B then transits from zero to Vin, and the above action repeats. At the end of every cycle, the energy stored in the inductor 420 gets completely transferred to the output.

Converter 400 includes free running oscillator 450. Free running oscillator 450 includes Schmitt trigger 456. In addition, resistor—capacitor network 466 is associated with Schmitt trigger 456 to connect the output of Schmitt trigger 456 to switch 160. The resistor—capacitor network 466 includes network capacitor 464 and network resistor 458 in parallel. The free running oscillator includes Schmitt trigger 456, trigger capacitor 454 and trigger resistor 452.

During operation, trigger capacitor 454 and first capacitor are charged up via resistor 452 until node A reaches a trigger point for Schmitt trigger 456. Then node B switches to 0V and switch 160 becomes open and not conducting. The inductor current I ind which developed before during time ton, continues to flow through rectifier diode 472 to the output and decreases linearly with time.

Exemplarily, Schmitt capacitor 454 has a capacitance value of 470 pF. Trigger capacitor 454 also includes trigger capacitor node 462. In addition, trigger capacitor 454 is also connected to ground.

Exemplarily, Schmitt resistor 452 has a resistance of about 10,000 ohms. Trigger resistor 452 is also associated with resistor—capacitor network 456 and with second capacitor node 462.

Trigger node A is configured between first capacitor 430 and second capacitor node 462. Trigger node A communicates a voltage located between first capacitor 430 and second capacitor node 462 to Schmitt trigger 456.

Schmitt trigger 456 can react with different threshold levels depending on whether the voltage input through trigger node A is on a positive or negative transition. In some embodiments, converter 400 may employ a trigger other than a Schmitt trigger.

Converter 400 includes switch 460 to connect inductor second inductor node to ground. Switch 460 is associated with resistor—capacitor network 466 and second inductor node 424. Switch 460 is configured to connect to ground when closed.

When switch 460 is closed, first capacitor 430 and second capacitor Schmitt capacitor 454 would become charged via trigger resistor 452 (only by the current through trigger resistor 452) until trigger node A reaches the trigger threshold and Schmitt trigger 456 closes the switch 460 when the trigger threshold Uth is reached.

Figure 5:
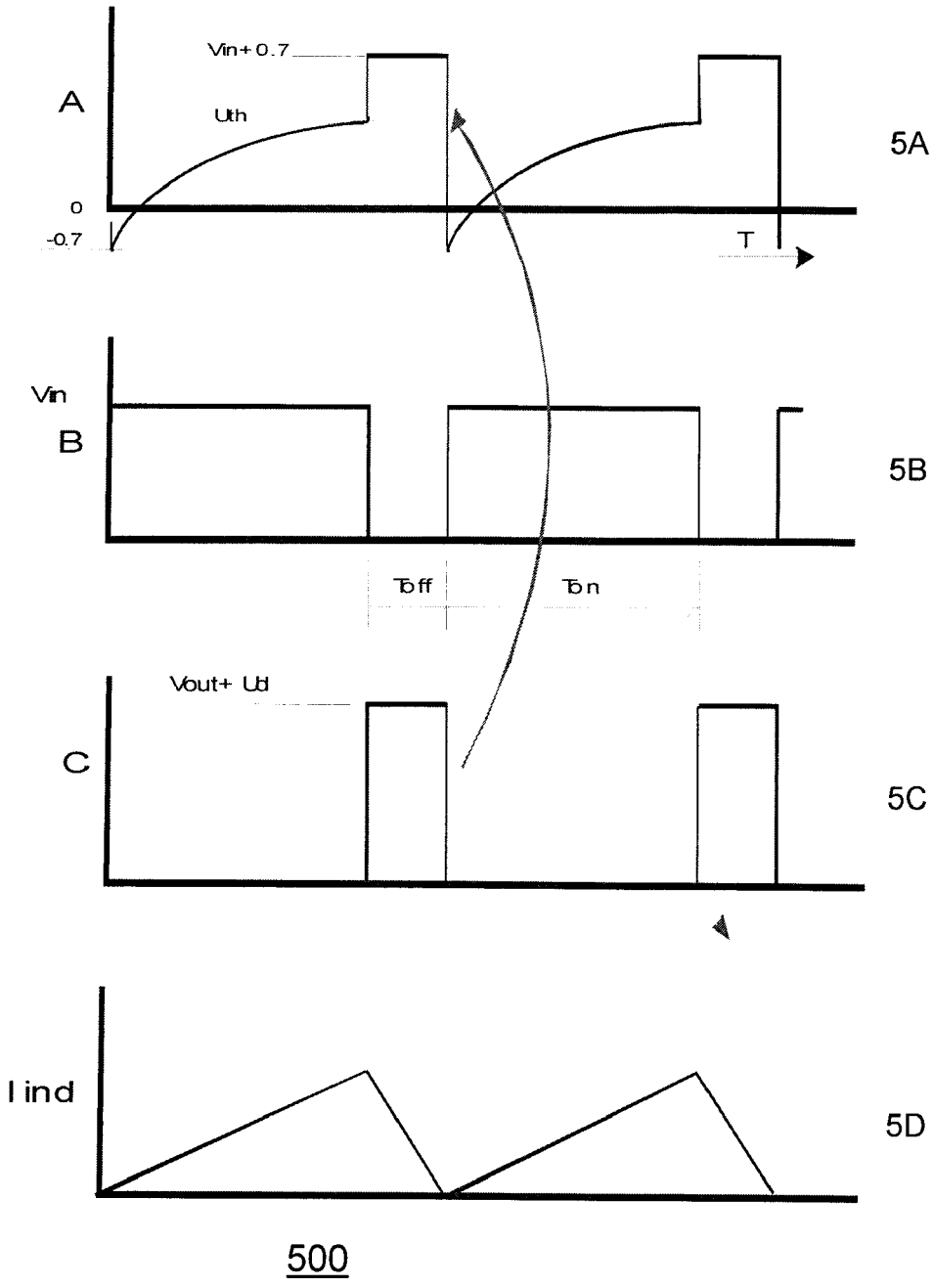
FIGS. 5A-5D exemplarily illustrates behavior 500 of bias voltage converter 400.

FIGS. 5A to 5D exemplarily illustrates behavior 500 of converter 500. Referring to FIG. 5B, Vin oscillates from −0.7 volts to 2.5 volts. When node A of FIG. 4 is at 0V and node B is at Vin, Schmitt capacitor 454 and second capacitor charge up until node A reaches, the trigger Voltage Vth high, reaches a trigger threshold for Schmitt trigger 450. Once the trigger threshold is met, node B switches to 0V and switch 460 opens.

Referring to FIG. 5A, the voltage across node A increases from −0.7 volts during time ton until the Schmitt trigger 456 trigger voltage Uth is reached. During time toff, the voltage across node A increases to the sum of input voltage Vin and 0.7 volts. Referring to FIG. 5C, the voltage across second inductor node 424 is at 0.0 volts during time toff and at a sum of the output voltage Vout and an output Ud of the inductor 420 during time ton.

Referring to FIG. 5D, the inductor current I ind is exemplarily illustrated as rising during time toff and falling during time ton. Referring to FIGS. 5C and 5D, when the inductor current I ind reaches zero, the voltage at node C abruptly goes low and causes a negative voltage step at the second inductor node 4242 via first capacitor 430. At that point, node B transits from zero voltage to input voltage Vin, and the cycle repeats. At the end of every cycle, the energy stored in the inductor 420 gets completely transferred to the output.

Figure 6:
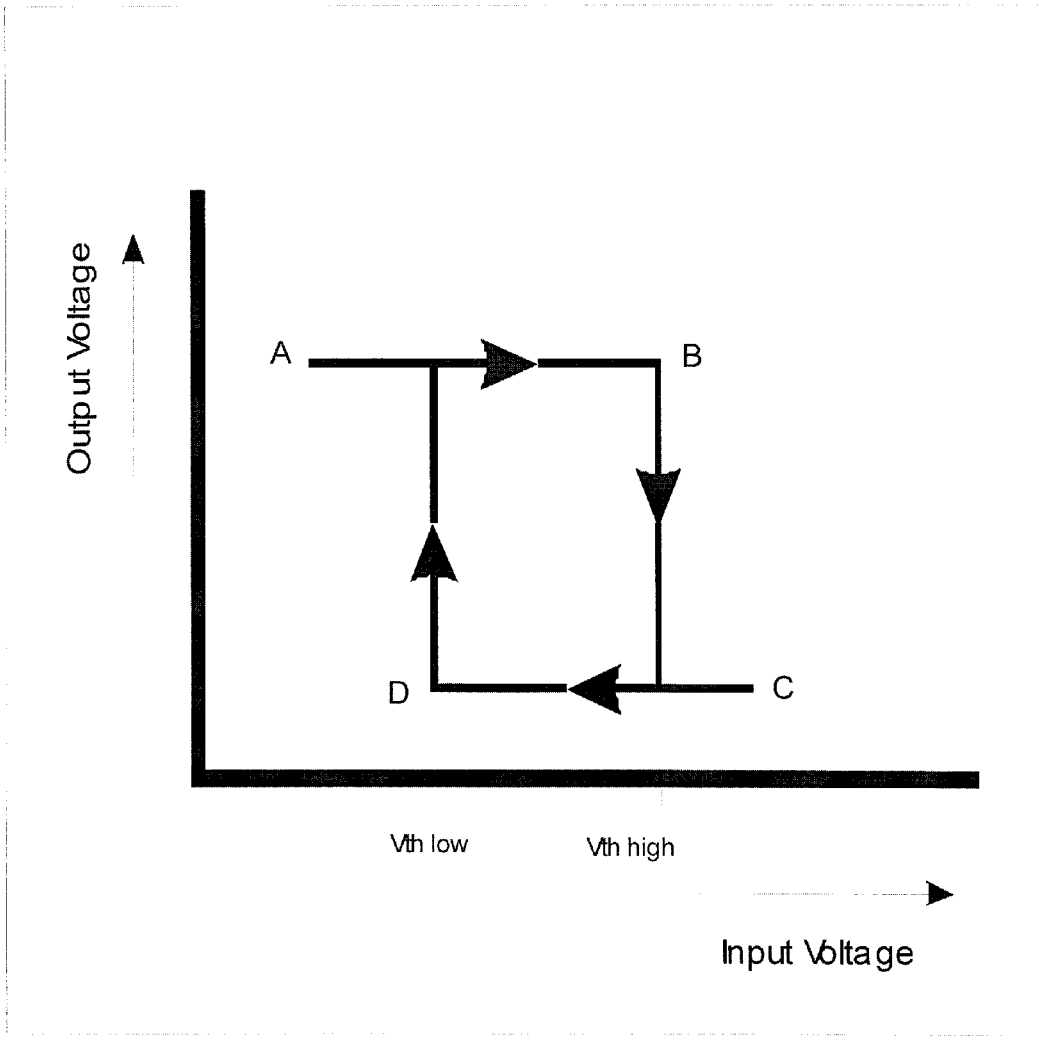
FIG. 6 exemplarily illustrates behavior 510 of a Schmitt Trigger.
Figure 7:
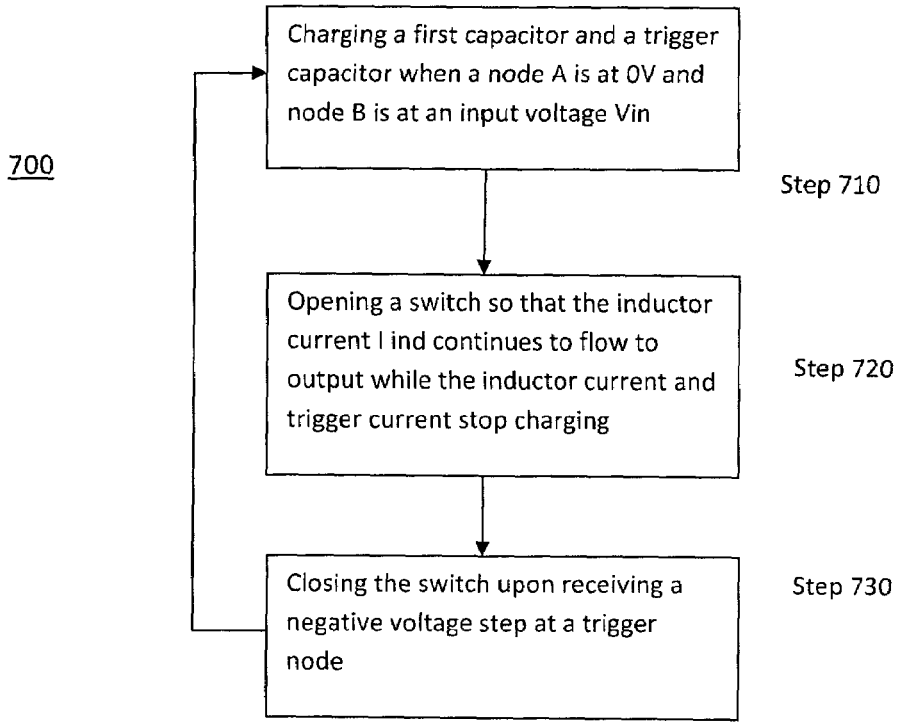
FIG. 7 exemplarily illustrates a method 700 for providing a bias voltage.

Referring to FIG. 6, exemplary behavior 510 of a Schmitt trigger has typically 2 threshold levels a $Vth_{high}$ and a $Vth_{low}$. When the output of the Schmitt trigger is high (point A) and its input voltage moves from low towards high, its output reacts (goes low) when the input voltage gets above $Vth_{high}$ (A=>B=>C).

Also when the output of the Schmitt trigger is low (point C) and its input voltage moves from high towards low, its output reacts (goes high) when the input voltage gets below $Vth_{low}$. (C=>D=>A).

When switch 460 is open, inductor element 420 drains. When inductor element 420 is drained and, when inductor current Iind reaches zero, an inductor voltage provides a negative voltage step at trigger node A via first capacitor 430. When the negative voltage step is provided to trigger node A, Schmitt trigger 456 directs switch 460 to close.

Converter 400 includes rectifier 472. Rectifier 472 would include rectifier 470. Rectifier 470 includes diode 472 and capacitor 474. Rectifier 470 is configured to transfer and store the energy of inductor 420 during Toff.

Converter 400 includes limiter diode 480 to prevent output voltage Vout from reaching excessive levels when, for example, less energy is used by the load.

First capacitor 430 is configured to limit Toff. Thus, as soon as first inductor 420 discharges all the energy contained therein that was stored during Ton and the energy from first inductor 420 being transferred to rectifier capacitor 474 (during Toff).

Schmitt diode 454 and second capacitor 430 are charged up via Schmitt resistor 452 until node A reaches Uth high (this happens during Ton). Once node A reaches Uth high, node B switches to 0V and switch 460 opens. After switch 460 opens, inductor current ind continues to flow through rectifier diode 472.

Thus, exemplary embodiments of the present invention can prevent the ringing generated by conventional converter circuits in a low load mode because the next load cycle (ton) of the inductor is initiated by the negative going slope of the inductor voltage. This keeps HF distortions at a minimum. In addition, exemplary embodiments of the present invention will always operate exactly in the transition between the continuous conduction mode) and the discontinuous conduction mode. Furthermore, the oscillator gets synchronized by the falling slope of the inductor when all the energy is transferred and the energy transferred to the output will not exceed a pre adjusted value (depending on Ton) and therefore measures for limitations are not necessary.

While the invention has been described in terms of a single exemplary embodiment, those skilled in the art will recognize that the invention can be practiced with modification within the spirit and scope of the appended claims.

Further, it is noted that, Applicants' intent is to encompass equivalents of all claim elements, even if amended later during prosecution.

Having thus described our invention, what I claim as new and desire to secure by Letters Patent is as follows:

1. A circuit to generate a bias voltage, the circuit comprising:

an inductor element including a first inductor node and a second inductor node, the inductor element configured to receive an input voltage at the first inductor node and to output an inductor current;

a first capacitor associated with the second inductor node;

a diode provided between the first capacitor and the first inductor node, the diode being configured to direct current towards the first inductor;

a free running oscillator, the free running oscillator comprising:

a trigger configured to react with different threshold levels depending on whether a trigger threshold voltage is on a positive transition or on a negative transition upon reaching a trigger threshold;

a resistor—capacitor network associated with the trigger;

a second capacitor being associated with ground, the second capacitor including a second capacitor node;

a trigger resistor, the trigger resistor including a first trigger node associated with the resistor—capacitor network and a second trigger node associated with the second capacitor node;

a trigger node configured between the first capacitor and the second capacitor node; and a switch associated with the resistor—capacitor network and the second inductor node, the switch configured to connect the inductor current to ground when closed, wherein the first capacitor and the second capacitor become charged via the trigger resistor by the inductor current until the trigger node reaches the trigger threshold and the trigger closes the switch when the trigger threshold is reached, wherein the inductor is drained when the switch is opened and, when the inductor current reaches zero, an inductor voltage provides a negative voltage step at the trigger node via the first capacitor, and wherein when the negative voltage step is provided to the trigger node, the trigger directs the switch to close.

* * * * *